US005236198A

United States Patent [19]

Haines et al.

[11] Patent Number: 5,236,198

[45] Date of Patent: Aug. 17, 1993

[54] GAMES RACKET FRAME

[75] Inventors: Robert C. Haines, Huddersfield; Michael E. Curtis; Andrew J. Marsden, both of Wakefield, all of England

[73] Assignee: Dunlop Limited, London, United Kingdom

[21] Appl. No.: 989,475

[22] Filed: Dec. 7, 1992

Related U.S. Application Data

[63] Continuation of Ser. No. 694,268, May 1, 1991, abandoned.

[30] Foreign Application Priority Data

May 2, 1990 [GB] United Kingdom ..... 9009831

[51] Int. Cl.[5] ..... A63B 49/08; A63B 53/14

[52] U.S. Cl. ..... 273/73 R; 273/73 J; 273/80.4

[58] Field of Search ..... 273/73 R, 73 C, 73 G, 273/73 J, 75, 67 R, 81 R, 81.2, 80 B, 80.4

[56] References Cited

U.S. PATENT DOCUMENTS

| | | | |
|---|---|---|---|
| 4,082,273 | 4/1978 | Ellzey | 273/73 J |
| 4,194,738 | 3/1980 | Inoue et al. | 273/73 C |
| 4,340,226 | 7/1982 | Haines | 273/73 J |
| 4,367,871 | 1/1983 | Schiefer | 273/73 J |
| 4,600,194 | 7/1986 | Donnelly | 273/73 G |
| 4,609,198 | 9/1986 | Tarr | 273/73 J |
| 4,627,635 | 12/1986 | Koleda | 273/73 J |
| 4,736,949 | 4/1988 | Muroi | 273/73 J |
| 4,746,119 | 5/1988 | Jeanrot | 273/73 C |
| 4,826,167 | 5/1989 | Lo | 273/73 J |
| 4,875,679 | 10/1988 | Movilliat et al. | 273/73 R |
| 4,906,002 | 3/1990 | Goffney et al. | 273/73 G |

FOREIGN PATENT DOCUMENTS

| | | | |
|---|---|---|---|
| 0221688 | 5/1987 | European Pat. Off. . | |
| 3139006 | 4/1983 | Fed. Rep. of Germany . | |
| 825660 | 12/1937 | France | 273/73 J |
| 8904698 | 6/1989 | PCT Int'l Appl. . | |
| 9005567 | 11/1989 | PCT Int'l Appl. . | |
| 30153 | 6/1910 | United Kingdom . | |
| 1600869 | 10/1981 | United Kingdom | 273/73 J |
| 2163963 | 3/1986 | United Kingdom . | |
| 2149311 | 2/1987 | United Kingdom . | |
| 2230458 | 10/1990 | United Kingdom . | |

OTHER PUBLICATIONS

European Search Report dated Jul. 13, 1991.

*Primary Examiner*—V. Millin
*Assistant Examiner*—Steven B. Wong
*Attorney, Agent, or Firm*—Lorusso & Loud

[57] ABSTRACT

A games racket frame is discontinuous being in two parts (11, 12). The parts (11, 12) are joined by a vibration-damping material (21) secured in position by plugs (23, 24). A reinforcing member (14) is also provided and this may comprise a collar (20) surrounding the discontinuity (13), together with a rod (25) contained within the vibration-damping material (21). Rackets according to the invention exhibit reduced transmission of shock and vibration to the player, thus minimizing the risk of "tennis elbow" and similar injuries.

16 Claims, 4 Drawing Sheets

GAMES RACKET FRAME

This is a continuation of copending application(s) Ser. No. 07,694,268 filed on May 1, 1991, now abandoned.

This invention relates to a games racket frame which includes a vibration-damping element isolating the head portion of the racket from the handle portion.

According to the present invention, the portion of the racket which is gripped by the player i.e. the handle portion is effectively decoupled and mechanically isolated from the portion of the racket which is impacted by the ball or other projectile.

Thus, the present invention provides a games racket frame having a head portion for stringing, a shaft portion and a handle portion, the frame being discontinuous in that it comprises two parts of which one part includes the head portion and the other part includes the handle portion or part thereof, in which the said two parts are connected together by means of a coupling assembly, the said coupling assembly comprising a connecting member of a vibration-damping material and one or more reinforcing members engaging the vibration-damping material and being located so as to overlap both of the said two parts, the vibration-damping material being bonded to the said two parts and to each of the said reinforcing members, whereby the said two parts are inseparably connected together, but mechanically isolated one from the other, by the vibration-damping material.

The vibration-damping material may suitably be a thermosetting or a thermoplastics material and especially an injectable material, for example a polyurethane resin. A suitable material may be based upon an elastomeric material compounded to produce the properties of a vibration-damping material.

A preferred polyurethane resin comprises an injectable thermosetting elastomeric material particularly in the form of a two-part, curable polyurethane which is mixed in liquid form and can therefore be readily injected and subsequently cured in situ. Such a material is available from Compounding Ingredients Limited as CILCAST 101 (which is cured by the addition of CILCURE B). The words CILCAST and CILCURE are Registered Trade Marks. The hardness and resilience of the vibration-damping materials are measured according to British Standard (B.S.) tests which are internationally available and familiar to the skilled artisan. Such a material has the properties desirable for the vibration-damping material of the present invention being of a hardness greater than 60° SHORE A measured according to BS 2782 Part 3 Method 365 B: 1992: Determination of and resilience below 20% when measured according to BS 903 Part A8 Method B. More preferably the vibration-damping material has a hardness in the range 70° to 95° SHORE HARDNESS measured according to BS 2782 Part 3, Indentation Hardness by Durometer (SHORE A) the preferable resilience for the vibration-damping material being in the range 5 to 15% measured according to BS 903 Part A8 199: Method B Method for Rebound Resilience.

The term vibration-damping material has its usual meaning in the art, i.e., a material of low resilience where resilience is defined as the percentage of energy returned after putting energy in, in terms of a force-deflection. In The British Standard test B.S. 903: Part A8: 1990: Method B a pendulum is dropped onto an elastomeric sample and the percentage rebound is measured which at 5 to 15% means that 95 to 85% of the energy is absorbed by the elastomer, this indicating an excellent vibration-damping material.

The term "mechanical isolation" in the context of a games racket construction would be understood in the art to mean that vibrations produced in the head portion cannot pass into the handle portion without travelling into the vibration-damping material (where they are substantially absorbed), there being no direct contact between head portion and handle portion.

Preferably the vibration-damping material is self-bonding to the reinforcing members and the two parts of the racket frame i.e. no separate adhesive is required. The aforementioned two-part curable polyurethanes have this desirable property.

In a first preferred embodiment of the present invention, the reinforcing member consists of a sleeve or collar to be located on the exterior of the frame in a position corresponding to that of the vibration-damping material.

Preferably, those portions of the frame which are to be connected by the coupling assembly are of reduced external diameter, whereby the sleeve or collar lies flush with the remaining portions of the frame on either side of the coupling assembly.

The sleeve or collar may be provided with one or more keying portions to engage the vibration-damping material.

In a second preferred embodiment of the present invention, the reinforcing member includes one or more rods extending across the discontinuity between the two frame parts, to be located within the vibration-damping material. The or each rod may be provided with one or more keying portions to engage the vibration-damping material. Suitably, the or each rod may be integrally formed with the collar or sleeve, for example a rod may extend along the longitudinal axis of the collar or sleeve.

In a third preferred embodiment of the present invention, the reinforcing member consists of a plate to be located within the vibration-damping material. Those parts of the frame which are connected by means of the coupling assembly may be provided with rebates to receive the plate. Additional reinforcing means, such as one or more pins extending in a radial direction through each frame part and the plate, may be provided.

Preferably the games racket frame is in two parts only i.e. only one coupling assembly is used. It may be possible to have more than one coupling assembly in which case the frame would be in three or more parts.

The present invention will be illustrated, merely by way of example, in the following description and with reference to the accompanying drawings.

Figure 1:
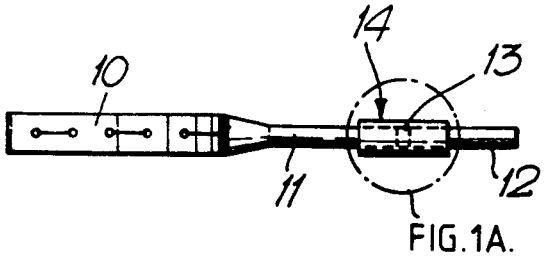
FIG. 1 is a schematic side elevation of a games racket frame according to the present invention.
Figure 1A:
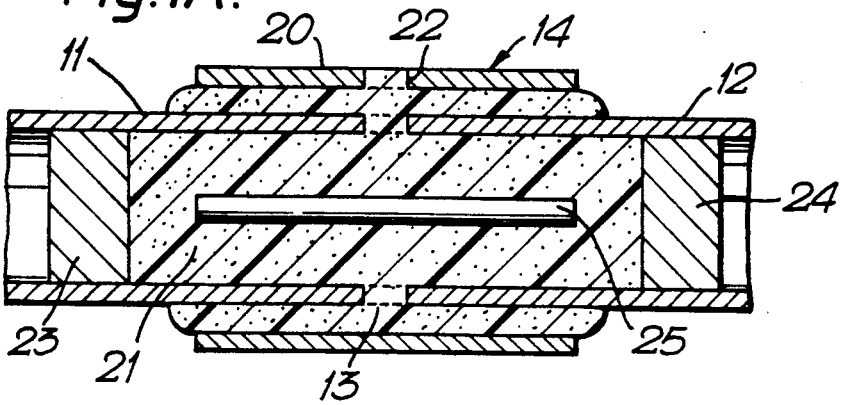
FIG. 1A is an enlarged sectional view of the "circled" portion of FIG. 1.

Referring to FIGS. 1 and 1A, a racket frame comprises a head 10 for stringing, a hollow shaft 11 and a handle 12. The shaft is cut through at 13 and the shaft and handle are subsequently connected by means of a coupling assembly 14. The coupling assembly 14 consists of a sleeve or collar 20 surrounding the shaft at the position 13 of the cut. The region between the co-operating ends of the shaft 11 and handle 12 is filled with an elastomeric material 21, injected through an injection-hole 22 in the sleeve 20 and retained in position by means of plugs 23 and 24. A reinforcing rod 25 is contained within the elastomeric material 21.

Figure 2:
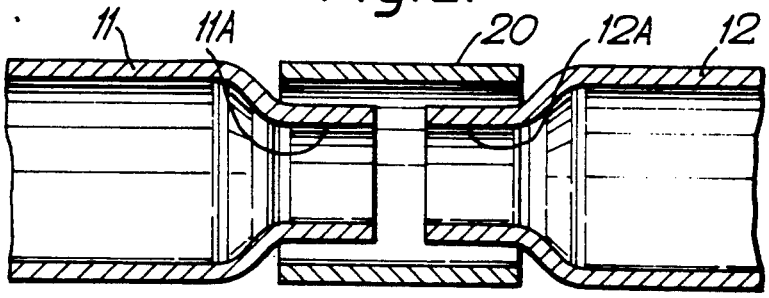
FIG. 2 is a sectional view of a racket frame according to the first preferred embodiment of the present invention.

In FIG. 2, the shaft 11 and handle 12 are respectively provided with portions 11A and 12A of reduced external diameter, so that on completion of the coupling assembly the sleeve 20 will lie flush with the remaining portions of the shaft and handle.

Figure 3:
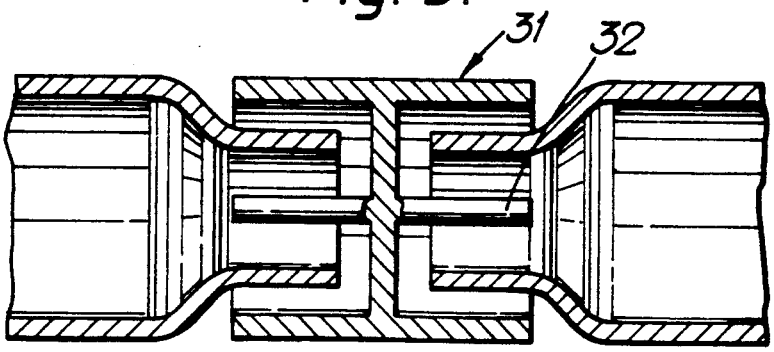
FIG. 3 is a sectional view of a racket frame according to the second preferred embodiment of the present invention.
Figure 3A:
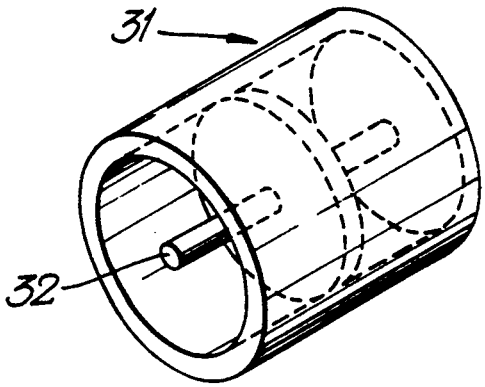
FIG. 3A is a schematic perspective view of the coupling assembly of FIG. 3.

In FIGS. 3 and 3A, the reinforcing member comprises a generally cylindrical sleeve 31 with an integral rod 32 extending along the longitudinal axis of the sleeve.

Figure 4:
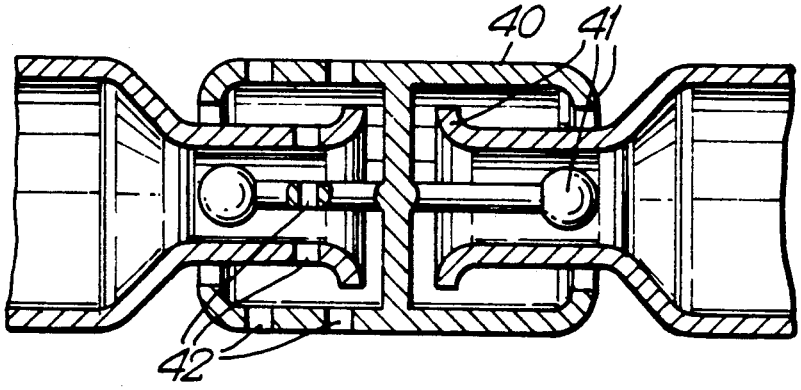
FIG. 4 is a sectional view of a first alternative construction for the coupling assembly of FIG. 3.

Referring to FIG. 4, reinforcing member 40 again comprises a generally cylindrical sleeve with an integral rod extending along the longitudinal axis of the sleeve, but including keying portions (indicated at 41 and 42) for enhanced attachment to the elastomeric material.

Figure 5:
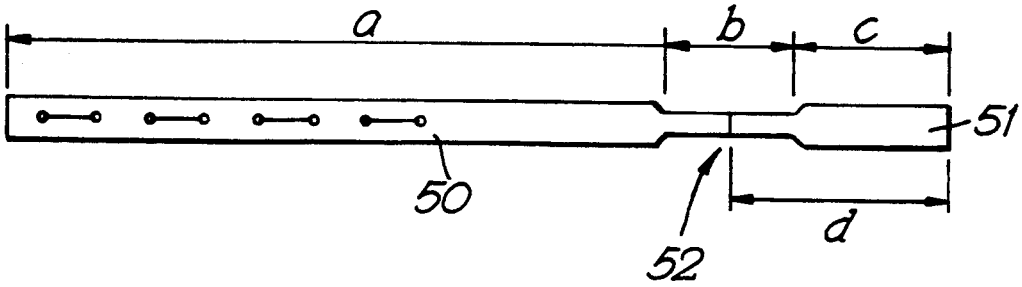
FIG. 5 is a schematic side elevation of a games racket frame according to the present invention, showing suitable relative dimensions of the two parts which are to be connected by the coupling assembly.

FIG. 5 is a schematic view of a tennis racket frame having a head/shaft portion 50 and a handle/shaft portion 51. The preferred position of separation of the portions 50 and 51 is shown at 52 and the dimensions of portions 50 and 51 are indicated by a, b, c and d respectively. In the example shown in FIG. 5, the dimensions were as follows:

a=510 mm
b=50 mm
c=125 mm
d=150 mm

In practice, the dimension "d" (distance from the butt of the handle to the point of separation of the two portions 50 and 51) may be in the range 40 mm to 330 mm, preferably 100 mm to 200 mm and ideally about 150 mm.

Preferably the coupling assembly is positioned such that in the finished games racket it would be covered by a grip (e.g. of wound leather) and thus would be within the handle portion. This preferred construction would usually be satisfied by the dimension "d" of being in the range 100 mm to 200 mm.

Figure 6:
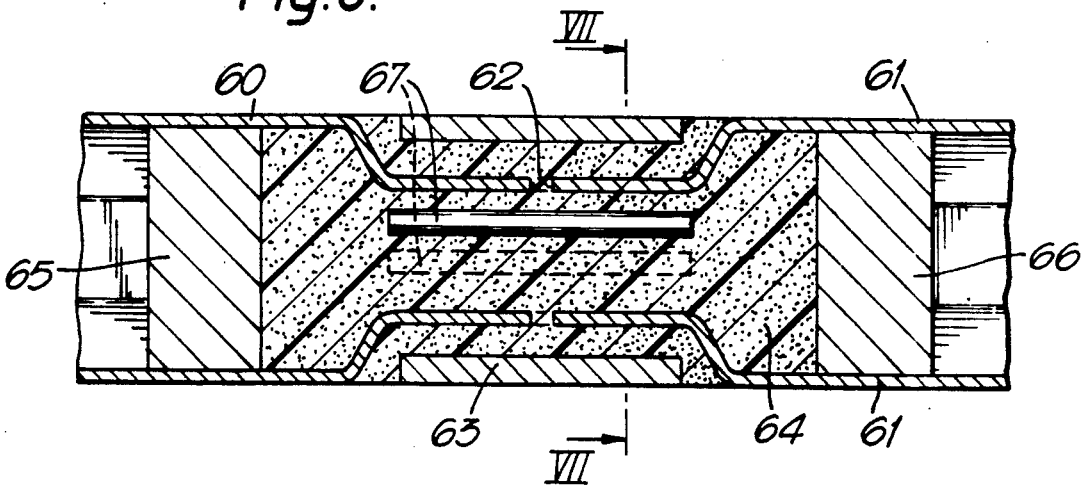
FIG. 6 is a sectional view of a second alternative construction for the coupling assembly of FIG. 3.
Figure 7:
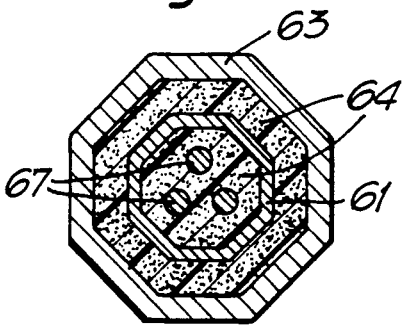
FIG. 7 is a section on line VII—VII of FIG. 6.

Referring now to FIGS. 6 and 7, the frame portions 60 and 61 are separated at a point of discontinuity 62. The portions are subsequently connected by means of a coupling assembly comprising a sleeve 63 and an element 64 of an elastomeric material, element 64 being retained in position by plugs 65 and 66. The coupling assembly includes rods 67 contained within the elastomeric material 64.

Figure 8:
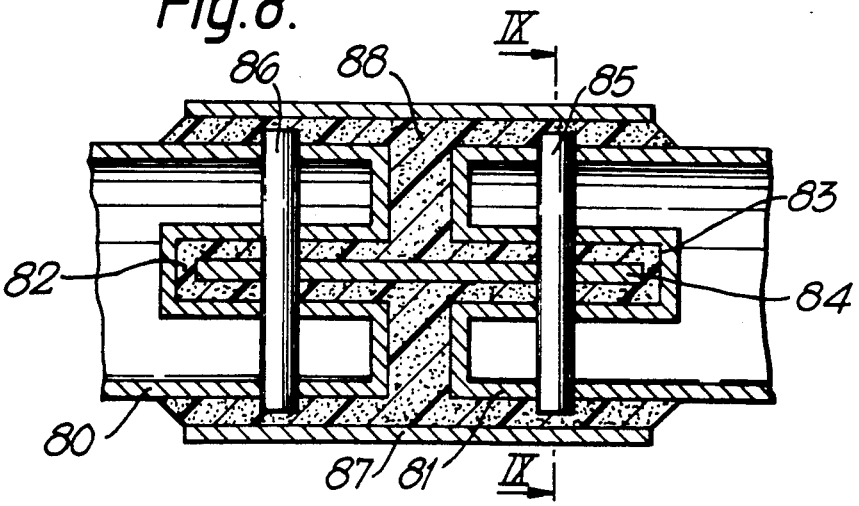
FIG. 8 is a sectional view of a racket frame according to the third preferred embodiment of the present invention.
Figure 9:
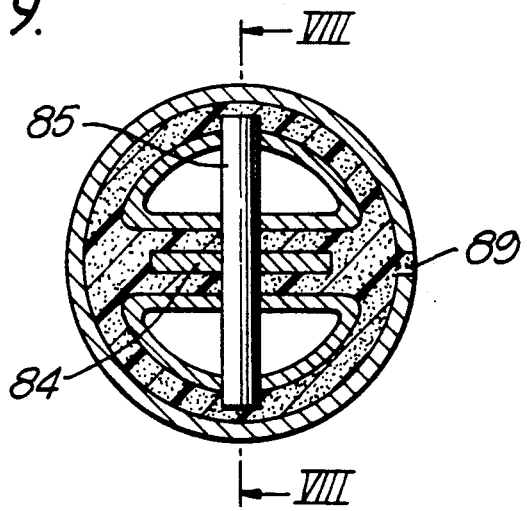
FIG. 9 is a section on line IX—IX of FIG. 8.

In FIGS. 8 and 9, frame portions 80 and 81 are provided with rebates 82 and 83 respectively to receive a reinforcing plate 84. The frame portions and the plate are drilled to receive pins 85 and 86 made from vibration-damping material. A sleeve 87 surrounds the assembly, which is completed by the injection of elastomeric material 88 through injection hole 89 in the sleeve. The orientation of the assembly is such that the plate 84 is perpendicular to the plane of the strings of the finished racket.

Figure 10:
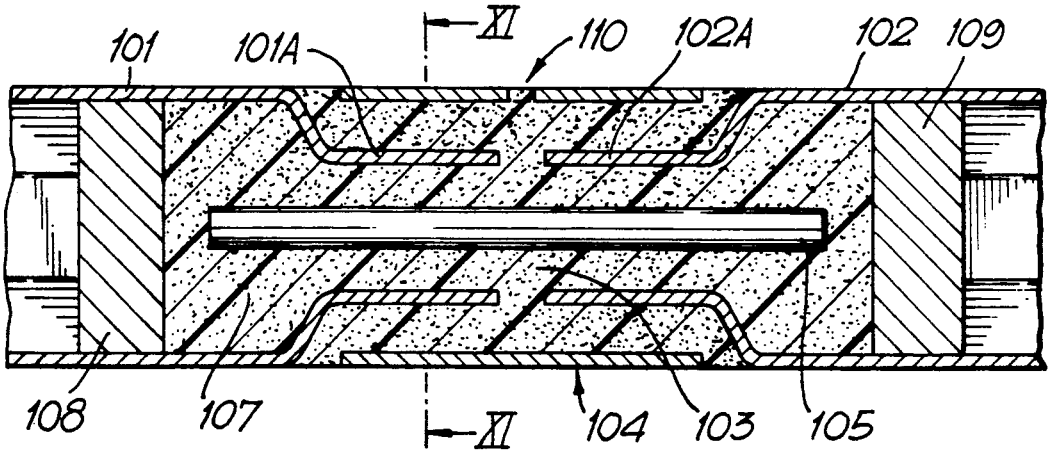
FIG. 10 is a sectional view of a racket frame in an alternative construction of the embodiment shown in FIGS. 8 and 9.
Figure 11:
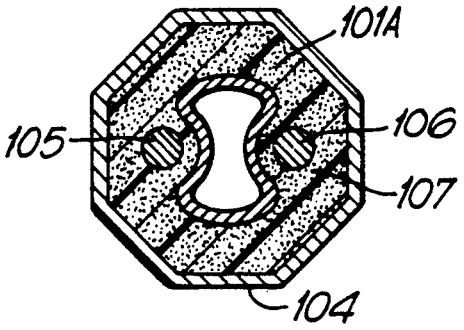
FIG. 11 is a sectional view on line XI—XI of FIG. 10.

Referring now to FIGS. 10 and 11, frame parts 101 and 102 are separated at a point of discontinuity 103. Parts 101 and 102 are respectively provided with portions 101A and 102A of reduced diameter, the said portions 101A and 102A being of closed, generally dumbbell section. The frame parts 101 and 102 are connected by means of a coupling assembly comprising a sleeve 104, rods 105 and 106 and an element 107 of an elastomeric material, element 107 being retained in position by plugs 108 and 109 and having been injected through injection hole 110.

In a further alternative embodiment (not illustrated) the two parts of the racket frame to be connected may be provided with co-operating flanges, in the manner of a pipe-joint, wherein the vibration-damping material acts as a gasket between the flanges.

The present invention will be further illustrated by way of the following Example:

EXAMPLE

Two identical rackets were made up from composite materials, using fabrics of carbon fiber and glassfiber impregnated with epoxy resin, as is well known to those skilled in the art.

One of the frames was cut through at a position 135 mm from the end of the shaft and a sleeve measuring 50 mm in length was located in position. Three separate reinforcing rods of length 50 mm and diameter 6 mm, made from carbon fiber reinforced nylon, were positioned as shown in FIGS. 6 and 7, and the space between the plugs was injected with liquid polyurethane resin (CILCAST 101/CILCURE B).

The racket frames were subsequently finished to the same weight and balance by affixing leather grips and by stringing in the customary way.

A test for vibration decay was made on the two rackets by fixing an accelerometer to the grip in each case and connecting this device to an oscillograph. Vibrations were set up in the frame by striking the strung area with a ball and the rate of vibration decay was measured in the two cases. Damping factors (see below) were computed for each racket and the following results were obtained:

| | | Damping Factor* |
|---|---|---|
| 1. | Racket with decoupled handle | 123 |
| 2. | Standard unmodified racket | 23 |

*Damping Factor is calculated as $\log_e\left(\frac{A_1}{A_2}\right)\times 1000$ in which $A_1$ and $A_2$ are the amplitudes of two successive vibration peaks taken from oscillograph readings of decaying vibrations.

It will be seen that the Damping Factor for the racket with the decoupled handle is significantly higher than that for the unmodified racket. This indicates that the effect of vibration on the player will be significantly less and so the tendency to tennis elbow and similar injuries, due to the transmission of shock and vibration, will be correspondingly diminished.

Racket frames according to the present invention may be made of wood, metal or composite materials.

Finally, the present invention also relates to a games racket including a frame as hereinbefore described.

We claim:

1. A games racket frame having a head portion for stringing, a shaft portion and a handle portion, the frame being discontinuous in that it comprises two parts of which one part includes the head portion and the other part includes at least a part of the handle in which the said two parts are connected together by means of a coupling assembly, the said coupling assembly comprising a connecting member of a thermoset vibration-damping material comprising a polyurethane elastomer having a rebound resilience in the range 5 to 15% measured according to British Standard B.S. 903 Part A8: 1990: Method B: Method for Rebound Resilience and a hardness of 70° to 95° Shore A measured according to British Standard B.S. 2782: Part 3: Method 365B: 1992: Determination of Indentation Hardness by Durometer (Shore Hardness) and one or more reinforming members engaging the vibration-damping material and comprising a sleeve or collar to be located on the exterior of the frame in a position corresponding to that of the vibration-damping material and one or more rods located within the vibration-damping material, the coupling assembly being located so as to overlap both of the said two parts, the vibration-damping material being bonded to the said two parts and to each of the said reinforcing members, whereof the said two parts are inseparably connected together but mechanically isolated one from the other by the vibration-damping material so that vibrations produced in the head portion pass through said vibration damping material and are substantially absorbed by said vibration damping material before reaching said handle portion.

2. A frame according to claim 1, in which the vibration-damping material is an injectable material.

3. A frame according to claim 1, in which those portions of the frame which are to be connected by the coupling assembly are of reduced external diameter, whereby the sleeve or collar lies flush with the remaining material portions of the frame on either side of the coupling assembly.

4. A frame according to claim 1, in which the sleeve or collar is provided with one or more keying portions to engage the vibration-damping material.

5. A frame according to claim 1, in which the or each rod is provided with one or more keying portions to engage the vibration-damping material.

6. A frame according to claim 1, in which the or each rod is integrally formed with the collar or sleeve.

7. A frame according to claim 6, in which the collar or sleeve is of generally cylindrical configuration and one rod extends along the longitudinal axis of the collar or sleeve.

8. A frame according to claim 1, in which the reinforcing member consists of a plate to be located within the vibration-damping material.

9. A frame according to claim 8, in which those parts of the frame which are connected by means of the coupling assembly are provided with rebates to receive the plate.

10. A frame according to claim 1, in which the length of the part which includes at least a part of the handle portion is in the range 40 mm to 330 mm.

11. A frame according to claim 1, in which the length of the part which includes at least a part of the handle portion is in the range 100 mm to 200 mm.

12. A frame according to claim 1, in which the length of the part which includes at least a part of the handle portion is about 150 mm.

13. A frame according to claim 1 wherein the coupling assembly comprises one coupling assembly member.

14. A frame according to claim 1, in which the vibration-damping material is self-bonded to the two parts and to each of the reinforcing members without a separate adhesive.

15. A games racket having a frame comprising a head portion for stringing, a shaft portion and a handle portion, the frame being discontinuous in that it comprises two parts of which one part includes the head portion and the other part includes at least a part of the handle in which the said two parts are connected together by means of a coupling assembly, the said coupling assembly comprising a connecting member of a thermoset vibration-damping material comprising a polyurethane elastomer having a rebound resilience in the range 5 to 15% measured according to British Standard B.S. 903 Part A8: 1990: Method B: Method for Rebound Resilience and a hardness of 70° to 95° Shore A measured according to British Standard B.S. 2782: Part 3: Method 365B: 1992: Determination of Indentation Hardness by Durometer (Shore Hardness) and one or more reinforcing members engaging the vibration-damping material and comprising a sleeve or collar to be located on the exterior of the frame in a position corresponding to that of the vibration-damping material and one or more rods located within the vibration-damping material, the coupling assembly being located so as to overlap both of the said two parts, the vibration-damping material being bonded to the said two parts and to each of the said reinforcing members, whereof the said two parts are inseparably connected together but mechanically isolated one from the other by the vibration-damping material so that vibrations produced in the head portion pass through said vibration damping material and are substantially absorbed by said vibration damping material before reaching said handle portion.

16. A games racket according to claim 15 further comprising a grip wherein the coupling assembly is within the handle portion and covered by said grip.

* * * * *

UNITED STATES PATENT AND TRADEMARK OFFICE

CERTIFICATE OF CORRECTION

PATENT NO. : 5,236,198

DATED : August 17, 1993

INVENTOR(S) : Robert C. Haines, Michael E. Curtis, Andrew J. Marsden

It is certified that error appears in the above-indentified patent and that said Letters Patent is hereby corrected as shown below:

Col. 1, line 25, after "parts" delete "," and insert --;-- ; line 60, after "A8" insert --:-- ; line 61, before ":" delete "199" and insert --1990-- ; line 61, before "Method for" insert --"-- ; line 61, after "Resilience" insert --"-- ; line 66, after "In" delete "The" and insert --the--; and Col. 5, line 31, after "more" delete "reinforming" and insert --reinforcing--.

Signed and Sealed this

Twenty-third Day of August, 1994

Bruce Lehman

*Attest:*

BRUCE LEHMAN

*Attesting Officer*

*Commissioner of Patents and Trademarks*